US005105749A

United States Patent [19]

Quist

[11] Patent Number: 5,105,749

[45] Date of Patent: Apr. 21, 1992

[54] METHOD OF MAKING A DRAPE WITH MULTIPLE BOX TUCKS AND A ROD POCKET

[76] Inventor: Paige S. Quist, 257 Riverdale Ave., Vacaville, Calif. 95687

[21] Appl. No.: 659,865

[22] Filed: Feb. 21, 1991

[51] Int. Cl.[5] ..... B32B 7/08; A47H 13/14

[52] U.S. Cl. ..... 112/262.1; 112/427; 160/348

[58] Field of Search ..... 112/427, 132, 144, 146, 112/262.1; 223/105; 160/348

[56] References Cited

U.S. PATENT DOCUMENTS

| | | | |
|---|---|---|---|
| 702,390 | 6/1902 | Arnold . | |
| 2,156,231 | 4/1939 | Stam | 112/427 X |
| 2,246,197 | 6/1941 | Wright | 112/427 X |
| 2,533,216 | 12/1950 | Bixter | 112/427 X |
| 2,600,908 | 6/1952 | Nachman | 112/427 |
| 2,893,336 | 7/1959 | Chinnici | 112/132 |
| 2,977,912 | 4/1961 | Madden | 112/262 |
| 3,094,090 | 3/1963 | Wyndham | 112/262 |
| 3,372,730 | 3/1968 | Kalder | 112/427 X |
| 4,599,958 | 7/1986 | Stiers | 112/262 |

*Primary Examiner*—Werner H. Schroeder
*Assistant Examiner*—Paul C. Lewis
*Attorney, Agent, or Firm*—David Pressman

[57] ABSTRACT

A drape with multiple horizontal superimposed box tucks (FIG. 1-78) secured by stitching is composed of one continuous piece of fabric (80) containing top (20*a*-20*b* to 24) and bottom (22*a*-22*b* to 24) rod pocket extensions, and multiple box tucks pockets (33, 35, 37). Top and bottom rod pocket extensions are joined by stitching (46) to form a rod pocket (70) which is subsequently gathered over a rod (75). The construction of the pocket (70) is such that multiple box tuck (78) projects off a center front location on the rod pocket (70). Upon gathering of the rod pocket (70) over the rod (75), multiple box tucks 78 produce the desired ruffle effect (FIG. 1).

6 Claims, 2 Drawing Sheets

METHOD OF MAKING A DRAPE WITH MULTIPLE BOX TUCKS AND A ROD POCKET

BACKGROUND

1. Field of Invention

This invention relates to a new method of making a drape. Specifically, it relates to an innovative method for making a drape with multiple pleats.

2. Discussion of Prior Art

In the drapery industry, drapes which are gathered into pleats on a drape rod have been manufactured for years. These are referred to as rod pocket drapes as described in U.S. Pat. Nos. 2,156,231 to Stam (1939) and 2,533,216 to Bixer (1950).

Rod pocket drapes on the market today have three parts. These include the header, which is a ruffle or fold of a single layer of fabric that projects from the top of the drape rod, the rod pocket, which is a fabric pocket that gathers over the drape rod, and the bottom extension, which is a fabric extension that projects from the bottom of the pocket.

The construction of rod pocket drapes is such that only a single ruffle can project from the top of the rod pocket. A single ruffle is one horizontal piece of fabric that forms vertical folds when gathered along one edge. The construction also prohibits any ruffle from projecting from the front of the rod pocket.

Rod pocket drapes are constructed of widths of fabric equal to twice the width of the drape rod; this construction is known as "two times fullness." This requires the cutting of widths of fabric to equal the required two times fullness amount. The procedures for cutting multiple widths of fabric to equal a desired fullness is very time consuming and costly.

Another well established drape has a type of pleat called a French pleat, described in U.S. Pat. No. 3,094,090 to Wyndham (1963), U.S. Pat. No. 4,599,958 to Steiger (1986) and U.S. Pat. No. 3,372,730 to Kalder (1968). A French pleat drape has sewn in pleats along its top borders. Drape hooks are installed in the pleats to allow the drape to hang from a drape rod assembly.

Unfortunately, drapes having French pleats are time consuming to manufacture and hence costly. The fabric must be formed by seaming together adjacent edges of stacked drapery material. The material also must be aligned with a fence of a laterally-movable seaming table. This requires a specialized and expensive piece of equipment. Next, a conventional bottom hemming is formed and a stiff heading fabric is added to the top of the drape for the pleats. The marking operation follows. In this the location where each pleat is to be sewn is marked along the top of the drape. The sections are then cut to width. After conventional side hemming steps and pleat forming operations are completed, two workers are required to perform fan folding. This requires several steps and workers to manufacture the drape. Therefore, the foregoing French pleat making procedure is very time-consuming and costly.

The term "box tuck" is well known in the dressmaker's art. U.S. Pat. No. 2,977,912 to Madden (1961) and U.S. Pat. No. 2,600,908 to Nachman (1952) discloses a single box tuck. A box tuck denotes a pleat that doubles both to the right and left. Spaced hidden folds are symmetrically disposed with respect to adjacent exposed folds. This is then stitched to be retained and held in folded position. This construction of box tucks allows only a single box tuck to be formed. Multiple box tucks, i.e., box tucks which are superimposed on top of each other, cannot be manufactured with this construction. Moreover it does not permit the widths of the tucks to be varied or graded (gradually increased in size).

OBJECTS AND ADVANTAGES

Accordingly, several objects and advantages of my invention are:

(a) to provide a new, easy-to-manufacture, and economical drape with multiple box tucks (hereafter referred to as MBT) and a rod pocket and a method of making same which overcomes all of the aforementioned difficulties;

(b) to provide an MBT rod pocket drape which will project from the front of the rod pocket and therefore the front of the rod;

(c) to provide an MBT rod pocket drape which can be made from existing widths of fabric, with a width of from two to five times fullness;

(d) to provide an MBT drape that can be manufactured without the many multiple manufacturing steps and extra workers required in the construction of other drapes, thus reducing time-consuming steps and cost;

(e) to provide an MBT that have multiple layers of tucks, either of equal widths or of varying widths;

(f) to provide a drape that can be produced with MBTs and not confined to a single box tuck.

Further objects and advantages of my invention are:

(a) to provide a multiple box tuck drape with a rod pocket that, upon gathering the rod pocket over a drape rod, will cause the MBTs to ruffle;

(b) to provide an MBT rod pocket drape which can be constructed with one continuous piece of fabric without horizontal seaming, unless one desires two colors of fabric;

(c) to provide an MBT rod pocket drape which can be utilized with any existing rods without incurring additional cost for new or specialized rods;

(d) to provide a drape that can be made with a basic home sewing machine by one reasonably skilled in the art;

(e) to provide an innovative drape which can be produced at the same cost as existing rod pocket drapes, thus providing a new product without the typical new-product costs;

(f) to provide an MBT drape which can be combined with a variety of already existing window draperies to produce innovative designs for the window covering industry;

(g) to provide an MBT which can be constructed with a piping-filled tuck in the center of subsequent MBTs;

(h) to provide an MBT which can be constructed with a decorative trim in the center of subsequent MBTs;

(i) to provide an MBT which can be ruffled and used in conjunction with a cornice board, a pillow, a headboard, a tie back, or a garment.

Still further objects and advantages will become apparent from a consideration of the ensuing description and drawings.

DESCRIPTION OF DRAWINGS

In the drawings, parts that are the same on each end have the same number with different alphabetical suffixes (21*a* and 21*b*).

REFERENCE NUMERALS IN DRAWINGS

20—edge of top rod pocket extension
21—side hem
22—edge of bottom rod pocket extension
24—seam line for MBT pocket
26—seam line for MBT pocket
28—seam line for MBT pocket
30—fold and seam line
32—bottom fabric fold line in pocket
33—pocket
34—bottom fabric fold line in pocket
35—pocket
36—bottom fabric fold line in pocket
37—pocket
38—top fabric fold line in pocket
40—top fabric fold line in pocket
42—top fabric fold line in pocket
44—needle extending from sewing machine
46—seam line of rod pocket
47—seam line alternate rod pocket
48—any fabric extension
50—edge of top and bottom rod pocket extensions
51—edge
52—alternate stitch line bottom rod pocket
60—straight stitch sewing machine
70—rod pocket
75—rod
76—tuck
78—MBT drape gathered to a rod
79—Alternative MBT drape gathered to a rod
80—fabric

DESCRIPTION OF FINISHED MBT DRAPE

FIGS. 1-2

Figure 1:
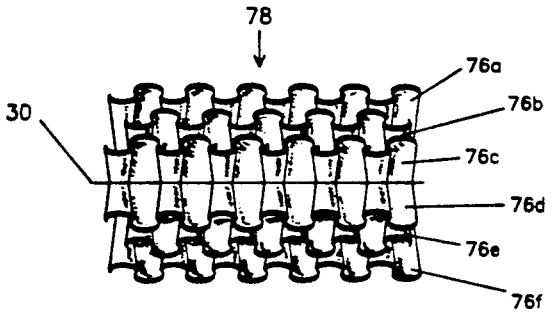
FIG. 1 shows a front view of an MBT drape showing an MBT ruffled from gathering on a rod with a rod pocket in accordance with the invention.

A typical finished, installed multiple box tuck (MBT) drape of the invention is illustrated in FIG. 1 (front view). This shows an MBT drape 78 after it is gathered onto a horizontal rod 75. Tucks 76*a*–76*f* are held in place by a stitch line 30. Tucks 76*a*–76*f* lie in a horizontal position with vertical folds and form multiple layers of ruffles which project forward and form the MBT drape 78.

Figure 2:
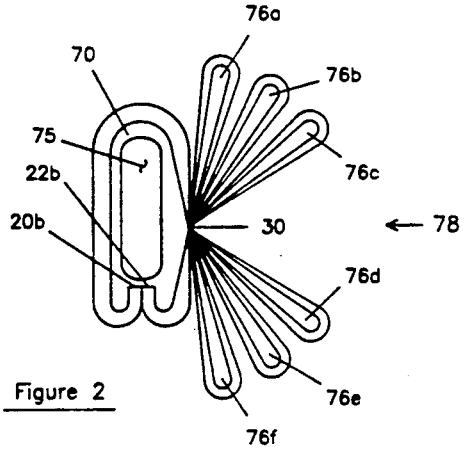
FIG. 2 shows an end view of the MBT drape of FIG. 1 (prior to gathering on the rod), showing a rod, a rod pocket, and an MBT.

FIG. 2 (end view) shows an MBT drape 78 with a rod 75 inserted into a rod pocket 70 prior to gathering the MBT drape 78. Tucks 76*a*–76*f* are held in place by a stitch line 30, and lie in a horizontal position forming multiple layers of tucks which form the MBT drape 78. The tucks 76*a*–76*f* project from the center front of the rod pocket 70. Rod pocket 70 is formed by an edge 20 and 22 being turned under and stitched together. After inserting the pocket 70 on rod 75, the MBT 78 is flat and unruffled. Upon gathering the pocket 70 to the rod 75, the drape will assume the attractive, innovative appearance of FIG. 1.

The manner of using the MBT with a rod pocket is similar to current rod pocket drapes. Rod 75 is inserted into rod pocket 70 and the drapery material is gathered on completely from one end to the other. The gathering of fabric rod pocket 70 over rod 75 causes an innovative and highly decorative ruffling effect of MBT 78, as shown in FIG. 1.

DESCRIPTION/CONSTRUCTION

FIGS. 3, 4, 5 and 6

Figure 3:
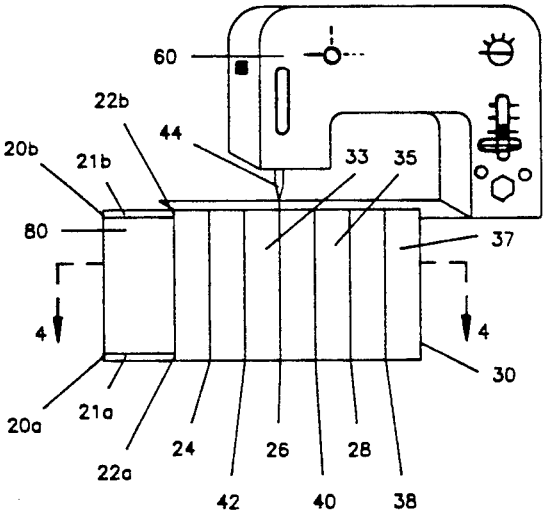
FIG. 3 shows a front-angled top view of a folded piece of fabric as it proceeds through a sewing machine where the MBT pockets are being sewn.
Figure 4:
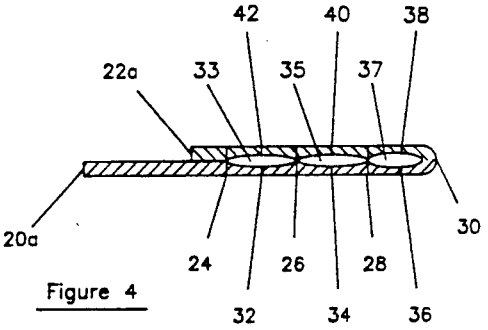
FIG. 4 shows a sectional view of the folded piece of fabric in FIG. 3.
Figure 5:
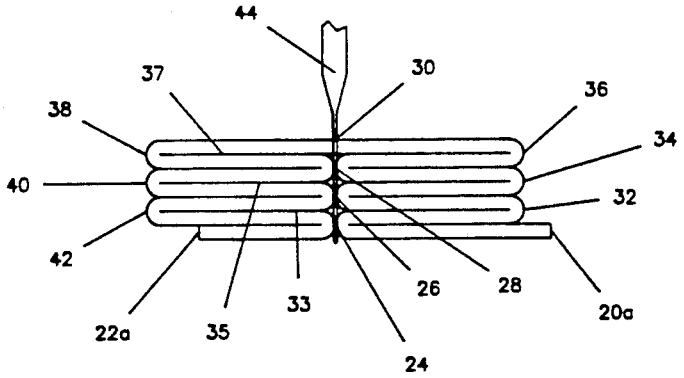
FIG. 5 shows an end view of the final stitching and securing of the horizontally folded-out sections of an MBT pocket.

The innovative and attractive MBT or multiple ruffle/pleat rod pocket drape of FIGS. 1 and 2 is constructed as shown in FIGS. 3 to 5 as follows:

FIG. 3 is a front angled top view of a sewing operation. The starting material is a flat piece of continuous fabric 80 which is rectangular or square in shape. The length of the fabric is equal to a specified fullness (e.g., 3 times the width of the rod). The width of the fabric is determined by adding the lengths necessary to form the rod pocket and the MBTs. Edges 20*a* to 20*b* and 22*a* to 22*b* are at opposite ends of piece of 80. Side hems 21*a* and 21*b* are turned under a specified amount (e.g., 2.5 cm) and top stitched to form finished edges. Piece 80 is then folded at fold line 30 so that its wrong sides come together.

In FIGS. 3 and 4 (sectional view) three parallel and adjacent seams 24, 26, and 28 are sewn to form box tuck pockets 33, 35, and 37, a top rod pocket extension (area 20*a* to 20*b* to stitch line 24), and a bottom rod pocket extension (area 22*a* to 22*b* to stitch line 24).

The width of each of pockets 33, 35, and 37 is two times the width of each single tuck 76*a* to 76*f*. The top extension (20*a* to 20*b* to stitch line 24) is three quarters of the length required to form rod pocket 75, plus 2.5 cm. A bottom extension (areas 22*a* to 22*b* to stitch line 24) is one quarter of the length required to form rod pocket 75, plus 2.5 cm.

In FIG. 4, pockets 33, 35, and 37 show fold lines 32, 34, 36, 38, 40, and 42. The respective lines are all parallel and exactly centered between stitch lines 24 and 26; 26 and 28; and 28 and fold 30.

FIG. 5 is an end view showing where fold lines 32 and 42, 34 and 40, 36 and 38, and edges 22*a* and 20*a* are pulled into opposite horizontal positions to form three horizontal box tucks with seams 24, 26, 28, and fold 30 superimposed. A threaded needle 44 is inserted through all superimposed seams 24, 26, 28, and fold 30, and these are sewn together with a straight stitch seam which is directly on top of fold line 30 to form tucks 76*a*–76*f* (FIG. 2).

Figure 6:
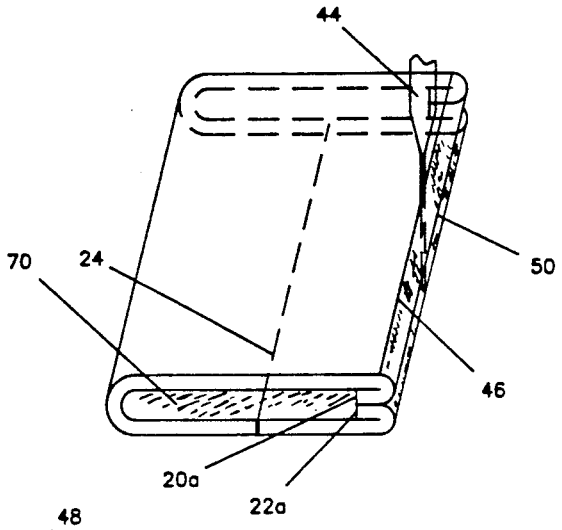
FIG. 6 shows an exploded top-angled end view of the rod pocket construction of the MBT drape.

FIG. 6 is an exploded top-angled end view showing where ends 20*a* to 20*b* and 22*a* to 22*b* are turned under 1.3 cm. They are placed horizontal and superimposed, forming edge 50. A threaded needle 44 is inserted through and permanently secures all superimposed layers together with a straight stitch seam 46 to form pocket 70. Pocket 70 is then inserted over rod 75.

DESCRIPTION/OPERATION OF ALTERNATIVE CONSTRUCTION

Figure 7:
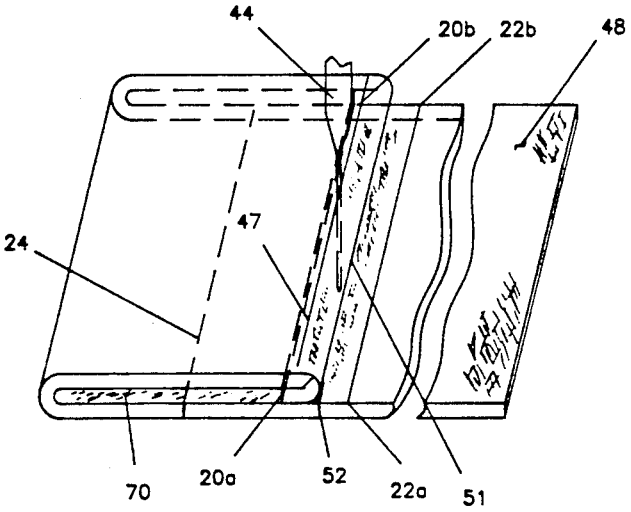
FIG. 7 shows an top-angled end view of an alternative rod pocket construction in accordance with the invention for any combinations of window drapes with the MBT drape.
Figure 8:
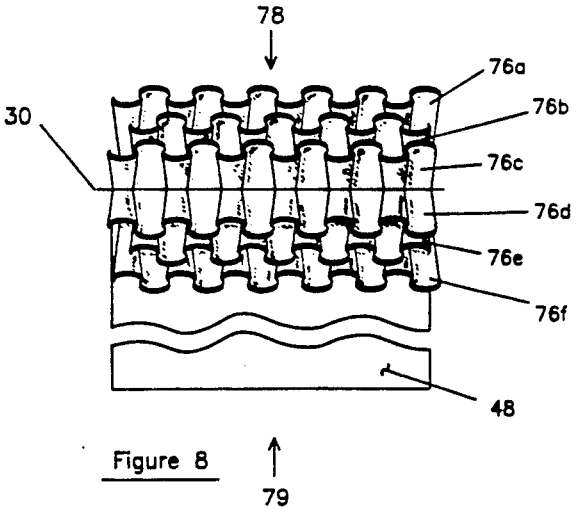
FIG. 8 shows a front view of an alternative MBT drape in accordance with the invention showing an MBT ruffled from gathering on a rod with the rod pocket, and an alternative drape extension hanging below the MBTs.

FIGS. 7 and 8

FIG. 7 (top angled end view) shows an alternative closure for rod pocket 70. Bottom extension 22 to 24 extends to encompass any standard drapery bottom 48. Top extension 20 to 24 has edge 20 turned under 1.3 cm. This forms new edge 51. A line 52 is marked 1.3 cm shorter than edge 22. Edge 51 is horizontally superimposed on marked line 52. A threaded needle 44 penetrates and permanently secures all superimposed layers with seam 47 forming rod pocket 70.

Additional embodiments are possible to provide a different number of horizontally superimposed box tucks. FIG. 5 (end view) shows three horizontal box tucks. Two or more than three layers of tucks can be provided, depending upon the type of fabric that is chosen. The layers of box tucks can have different widths, preferably with each box tuck layer being wider than the next box tuck layer superimposed on it.

The first most upper horizontal pocket 37 can be stitched with piping on the interior of the pocket. This provides a piping filled tuck in the center of subsequent MBTs.

FIG. 7 shows an alternative method for fabricating rod pocket 70 with a combination drape 48 extending from rod pocket extension 22. The rod pocket 70 is gathered to rod 75 in exactly the same manner as in FIG. 1.

FIG. 8 shows an alternative MBT drape 79 with the MBTs 78 ruffled after the rod pocket 70 is gathered over rod 75. It shows alternative drape 48 extending below MBT 78.

From the description above, a number of advantages of my MBT drape becomes evident:

(a) The MBT drape is constructed to allow for an innovative front projection of ruffles from the rod pocket.

(b) The MBT drape can be constructed with one piece of continuous fabric. This saves cutting cost, construction time, and money.

(c) The MBT drape is constructed to allow innovative ruffling to occur upon gathering the rod pocket to a rod.

(d) The MBT drape can be made from existing widths of fabric and from one to multiple times fullness. This eliminates the need to cut the widths of fabric used. This reduces time and subsequent costs.

(e) The MBT drape can be made to fit any size rod. The rod pocket construction conveniently allows any length of rod pocket that is needed to be easily made. This reduces the cost of purchasing new rods.

(f) The MBT drape can be manufactured on already existing basic equipment. It can be constructed using three machines. A serger machine or overedger is used for seaming widths of fabrics together. A blind hemmer machine is used for hemming the sides or the bottom hem if making an MBT drape with any combination drapery. A straight stitch machine will do all remaining steps in manufacturing the MBT drape. Thus, new or specialized equipment is not required.

(g) The MBT drape can be made with only a straight stitch machine if necessary. The seaming of widths of fabrics can be straight stitched with a clean finish edge. The hems can be top stitched. The rest of the MBT drape is produced with a straight stitch. This allows anyone with a basic straight stitch machine to be able to manufacture the drape. This produces a new product without new large equipment expense.

(h) The MBT can have multiple layers. The multiple layers can be of equal width. The multiple layers can also have varying widths. The first layer adjacent to the rod pocket can be wider than subsequent layers which are superimposed upon it. (i.e., each subsequent layer is narrower than the one before).

(i) The MBT drape can be constructed with an alternative rod pocket seam. This allows many combinations of drape extensions to hang below the MBT drape. This is done without extra seaming due to the one continuous piece of fabric construction method employed. This creates many innovative MBT drape combinations requiring only one rod and installed as such.

CONCLUSION, RAMIFICATIONS, AND SCOPE OF INVENTION

Accordingly, the reader will see that my multiple box tuck with rod pocket drape provides, for the window covering industry, a front projecting multiple ruffled window treatment. Furthermore, the MBT drape has additional advantages of:

providing a drape that can be used with existing rods, thereby eliminating costs for new or special rods;

providing a drape with construction techniques that are not more costly than current rod pocket drapes;

providing a drape that does not require new or special machinery to manufacture, thereby reducing costs of new drapery construction for the drapery market;

it is versatile since the number and widths of superimposed MBTs can be varied;

it allows a fabric trim to be inserted on the uppermost fold line, thereby creating an MBT with a center trim.

it allows piping to be inserted in the first pocket along the uppermost border, thereby creating a piping-filled tuck at the center of the MBTs. The piping can be pulled out causing the tuck to gather onto the piping. This creates a gathered-piping tuck at the center of the MBTs.

it allows for an extension of the bottom rod pocket extension to include many combinations of drapes. This produces a number of new combined window drapes with the MBT at the top;

it allows for the drape to be two to multiple times fullness. This eliminates the need for cutting exact widths of fabric, and allows a reduction of costs.

Although the description above contains many specificities, these should not be construed as limiting the scope of the invention but as merely providing illustrations of some of the presently preferred embodiments of this invention. For example, the MBT can be used on cornice boards, headboards, tie backs, pillows, and even clothing. It can function either as a flat MBT drape or as a ruffled MBT drape. The MBT drape can be made from any kind of fabric suitable for a window drapery. It can have any number of widths and fit any width window. The drape can be made with graduated sizes. Thus the box tuck sizes can graduate from any predetermined size to any desired length.

Thus the scope of the invention should be determined by the appended claim and their legal equivalents, rather than by the examples given.

I claim:

1. A method of making a multiple box tuck drape with a rod pocket extension, comprising steps of:

(a) folding a continuous piece of material so as to form two layers and so that hemmed side edges are superimposed;

(b) stitching a plurality of parallel and equally spaced rows to form a plurality of pockets on said piece of material, said pockets including an end pocket while leaving an upper and lower material extension extending from said end pocket;

(c) seaming said pockets to form a plurality of horizontal superimposed box tucks;

(d) seaming upper and lower extensions of said material which extends from last said pockets to form a rod pocket;

(e) said upper extension being equal in width to three-fourths a desired finished width of a rod pocket and said lower extension extending in width to encompass any alternative drape;

(f) inserting said rod pocket over a rod and gathering said rod pocket on a rod, thereby causing said plurality of horizontal superimposed box tucks to ruffle.

2. A method of making a multiple box tuck drape, comprising the steps of:

(a) folding a continuous piece of material having hemmed side edges so as to form two layers and so that said hemmed side edges are superimposed;

(b) sewing a plurality of parallel and equally spaced rows to form a plurality of pockets on said piece of material, said pockets including an end pocket, and such that upper and lower material portions extend from said end pocket;

(c) sewing said pockets into a plurality of horizontally superimposed box tucks;

(d) sewing said upper and lower material portions to form a rod pocket having a predetermined length; and (e) inserting said rod pocket over a rod and gathering said rod pocket on said rod, thereby causing said plurality of horizontally superimposed box tucks to ruffle.

3. The method of claim 2, wherein said sewing of step (c) is performed with a straight stitch seam which permanently secures all layers.

4. The method of claim 2, wherein said forming said plurality of pockets of step (b) is performed so that the widths of said pockets are twice a desired finished width of a tuck.

5. A drape comprising a continuous piece of fabric stitched to form a plurality of horizontal tucks, a rod pocket stitched at a rear center location to said horizontal tucks, wherein said plurality of horizontal tucks is shaped so that when a rod is inserted into said rod pocket, said tucks will ruffle and project from the front of said rod when said rod pocket is shirred.

6. The drape of claim 5, wherein said plurality of horizontal tucks are composed of multiple horizontal superimposed box tucks.

* * * * *